US005305849A

United States Patent [19]

Shaw

[11] Patent Number: 5,305,849

[45] Date of Patent: Apr. 26, 1994

[54] TREE STEP CADDY

[76] Inventor: Ray D. Shaw, Rt. 1, Box 52, Ennice, N.C. 28623

[21] Appl. No.: 55,285

[22] Filed: May 3, 1993

[51] Int. Cl.[5] ..... A63B 27/00

[52] U.S. Cl. ..... 182/92; 182/151; 224/253

[58] Field of Search ..... 182/90, 92, 151; 206/376, 377, 373, 315.1; 224/253, 901

[56] References Cited

U.S. PATENT DOCUMENTS 2,359,372 10/1944 Leader ..... 211/35 X
4,467,551 8/1984 Pulver ..... 206/315.1 X
4,697,669 10/1987 Bergster ..... 182/92
4,763,821 8/1988 Powell ..... 224/253 X
4,967,986 11/1990 Schildkraut ..... 224/202 X
4,998,653 3/1991 Cabelle ..... 224/253 X

*Primary Examiner*—Alvin C. Chin-Shue
*Attorney, Agent, or Firm*—Leon Gilden

[57] ABSTRACT

A pouch member is arranged to include a plurality of pockets therewithin, with each of the pockets having a climbing step member therewithin. Each step member having foldable first and second legs displaced to an orthogonal orientation relative to one another for permitting securement within a tree, as each first leg includes a spike member arranged for projection into an associated tree for a climbing procedure.

1 Claim, 3 Drawing Sheets

TREE STEP CADDY

BACKGROUND OF THE INVENTION

1. Field of the Invention

The field of invention relates to tree climbing apparatus, and more particularly pertains to a new and improved tree climbing kit apparatus wherein the same is arranged to include a pouch assembly having a plurality of step members therewithin for projection into an associated tree for climbing the tree structure.

2. Description of the Prior Art

Tree climbing members of various types are utilized throughout the prior art, wherein U.S. Pat. No. 4,775,030 indicates the use of a spike member arranged for threaded directing into a tree.

U.S. Pat. No. 4,697,669 to Bergsten is arranged to include a foldable tree step member.

Further, U.S. Pat. No. 4,000,788 sets forth a tree step member of unitary construction.

The instant invention attempts to overcome deficiencies of the prior art by providing for the organization arranged in a transportable pouch structure permitting the ease of assembly and removal of the step structure relative to the associated tree and in this respect, the present invention substantially fulfills this need.

SUMMARY OF THE INVENTION

In view of the foregoing disadvantages inherent in the known types of tree climbing apparatus now present in the prior art, the present invention provides a tree climbing kit apparatus wherein the same is arranged to employ a plurality of step members within an associated transportable caddy structure. As such, the general purpose of the present invention, which will be described subsequently in greater detail, is to provide a new and improved tree climbing kit apparatus which has all the advantages of the prior art tree climbing apparatus and none of the disadvantages.

To attain this, the present invention provides a pouch member arranged to include a plurality of pockets therewithin, with each of the pockets having a climbing step member therewithin. Each step member having foldable first and second legs displaced to an orthogonal orientation relative to one another for permitting securement within a tree, as each first leg includes a spike member arranged for projection into an associated tree for a climbing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tree step caddy which has all the advantages of the prior art tree climbing apparatus and none of the disadvantages.

It is another object of the present invention to provide a new and improved tree step caddy which may be easily and efficiently manufactured and marketed.

It is a further object of the present invention to provide a new and improved tree step caddy which is of a durable and reliable construction.

An even further object of the present invention is to provide a new and improved tree step caddy which is susceptible of a low cost of manufacture with regard to both materials and labor, and which accordingly is then susceptible of low prices of sale to the consuming public, thereby making such tree step caddies economically available to the buying public.

Still yet another object of the present invention is to provide a new and improved tree step caddy which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
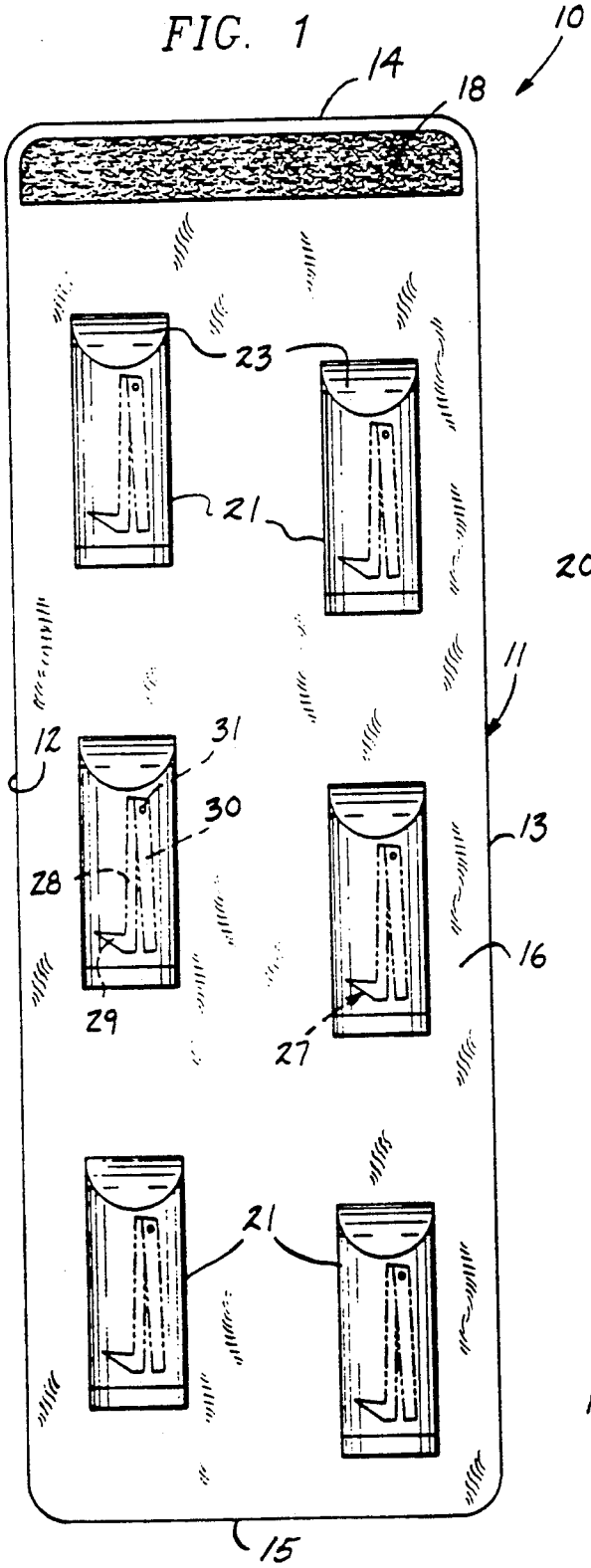
FIG. 1 is an orthographic interior view of the invention.
Figure 2:
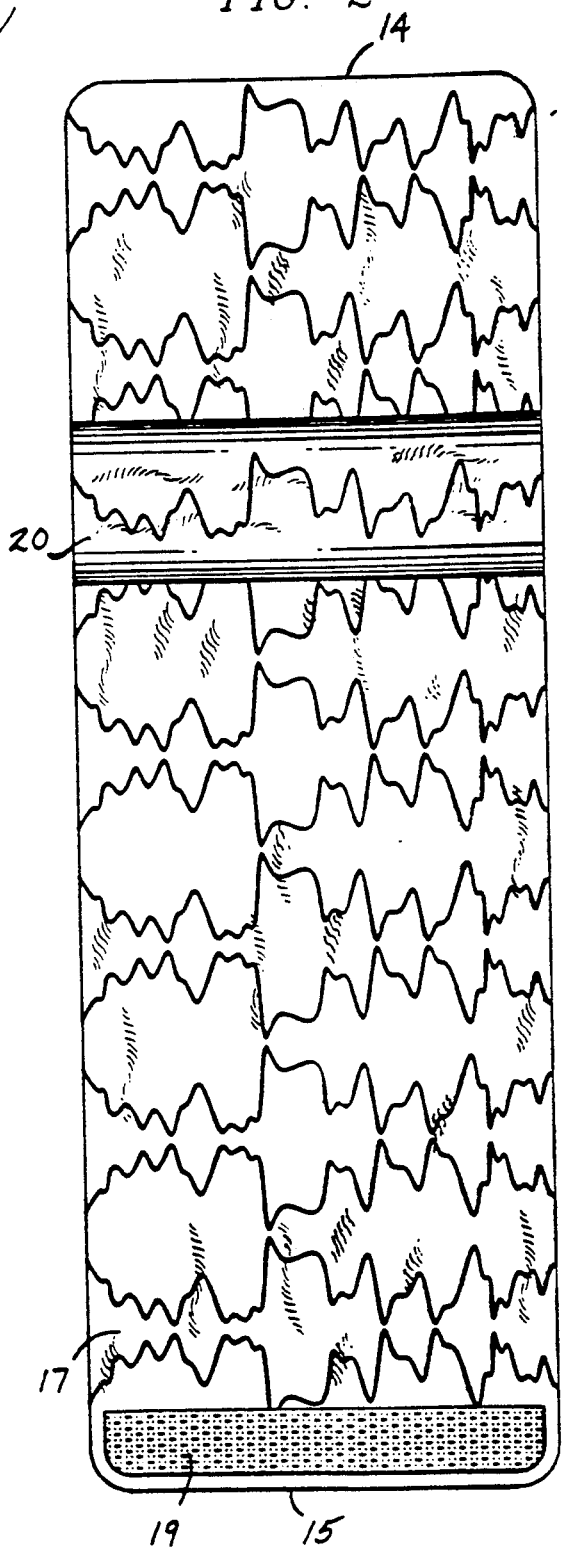
FIG. 2 is an orthographic exterior view of the pouch structure relative to FIG. 1.

With reference now to the drawings, and in particular to FIGS. 1 to 6 thereof, a new and improved tree climbing kit apparatus embodying the principles and concepts of the present invention and generally designated by the reference numeral 10 will be described.

Figure 3:
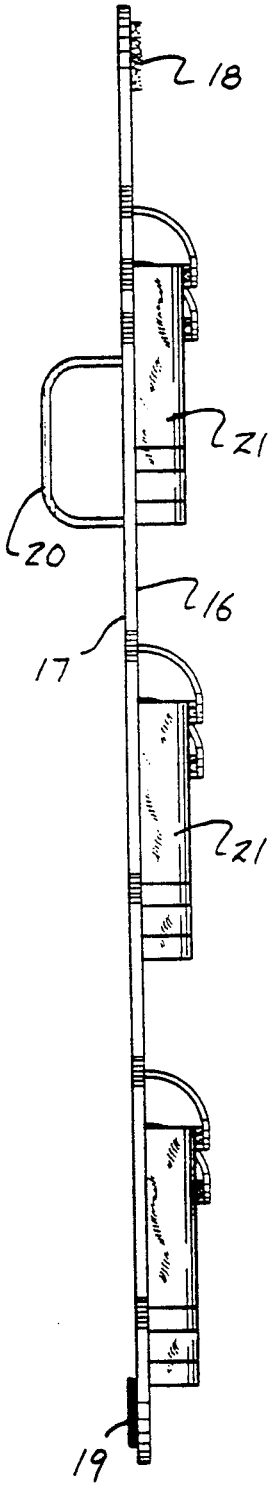
FIG. 3 is an orthographic right side view.
Figure 4:
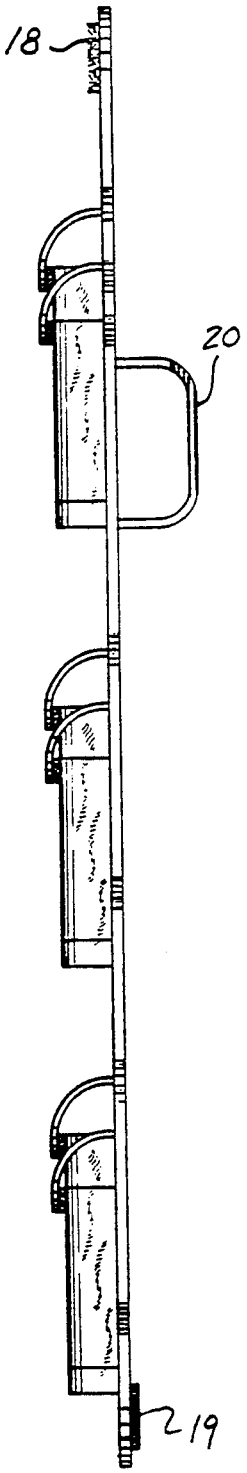
FIG. 4 is an orthographic left side view.
Figure 5:
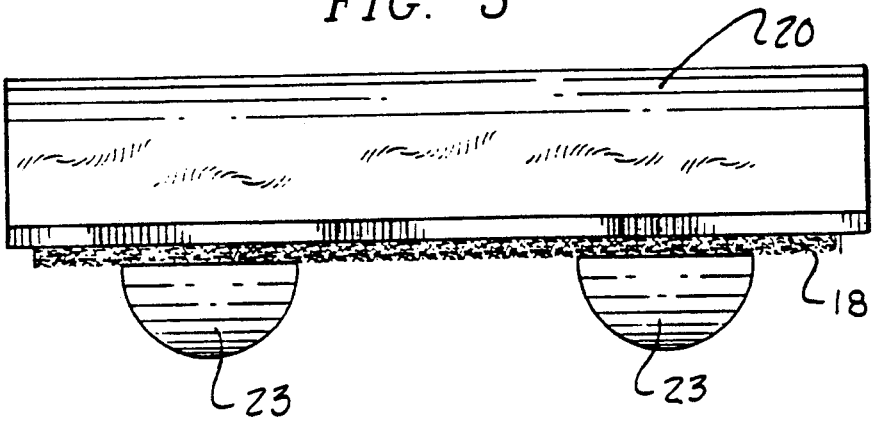
FIG. 5 is an orthographic top view of the invention.
Figure 6:
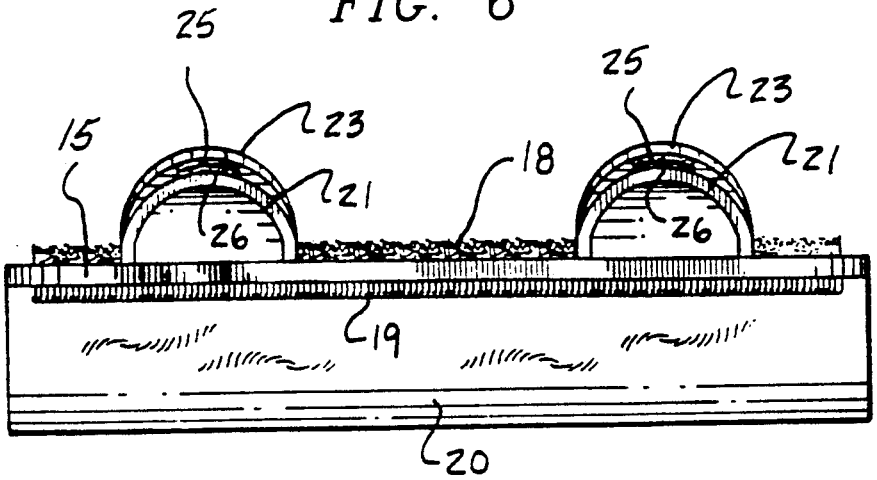
FIG. 6 is an orthographic bottom view of the invention.

More specifically, the tree climbing kit 10 of the instant invention essentially comprises a flexible web 11, having a web first side 12 spaced from a web second side 13, a web first end 14 spaced from a web second end 15, with the web having an interior surface 16 at an exterior camouflage surface 17. A first hook and loop fastener strip 18 is mounted to the interior surface 16 in adjacency to the first end 14 in a parallel relationship, with a second hook and loop fastener strip 19 arranged for securement to the first hook and loop fastener strip mounted to the exterior surface 17 adjacent the second end 15. A belt loop 20, or a plurality of such belt loops if desired, is mounted to the exterior surface 17 in adjacency to the first end 14, as illustrated in FIG. 3 for example. Parallel pockets 21 are mounted to the interior surface 16 in adjacency to the first hook and loop fastener strip 18, with a plurality of pairs of the parallel pockets 21 mounted to the interior surface 16 adjacent the second hook and loop fastener strip 19. The pockets 21 are arranged orthogonally relative to the first and second ends 14 and 15. The pockets 21 include respective flaps 23. The pocket flaps each include a pocket flap hook and loop fastener strip 25 (see FIG. 6) for securement to a pocket wall fastener strip 26. Within each of the pockets is a step member 27 having a first rigid leg 28, including a spike 29 pivoted to a second rigid leg 30 about a pivot axle 31. Such structure is exemplified in U.S. Pat. No. 4,697,669 incorporated herein by reference. It should be further noted that the pockets 21 are positioned symmetrically of the web 11 and more particularly of the interior surface 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tree climbing kit apparatus, comprising, a flexible web, the flexible web having a web first side spaced from a web second side, a web first end spaced from a web second end, and the web having an interior surface and a camouflage surface, with the interior surface including a first hook and loop fastener strip mounted to the interior surface in adjacency to the first end, and a second hook and loop fastener strip selectively securable to the first hook and loop fastener strip fixedly mounted to the exterior surface adjacent the second end, and a belt loop mounted to the exterior surface orthogonally oriented relative to the first end and fixedly secured to the exterior surface, and a plurality of pairs of pockets orthogonally oriented relative to the first end parallel to the first side and the second side mounted to the interior surface, with each of the pockets including a step member therewithin, and the pairs of pockets arranged in a symmetrical relationship relative to the interior surface, and defining two columns, with each pocket in a pair being staggered longitudinally with respect to each other in their respective column, and each step member includes a first rigid pivot leg mounted to a second rigid pivot leg about a pivot axle directed through the first rigid pivot leg and the second rigid pivot leg permitting orthogonal orientation of the first rigid pivot leg relative to the second rigid pivot leg.

* * * * *